US008910959B2

(12) United States Patent
Alva

(10) Patent No.: US 8,910,959 B2
(45) Date of Patent: Dec. 16, 2014

(54) FOLDING SPORTS BOARD AND TRUCK MOUNTING APPARATUS

(76) Inventor: Jordan Alva, Lake Park, FL (US)

( * ) Notice: Subject to any disclaimer, the term of this patent is extended or adjusted under 35 U.S.C. 154(b) by 558 days.

(21) Appl. No.: 13/053,108

(22) Filed: Mar. 21, 2011

(65) Prior Publication Data

US 2012/0068427 A1 Mar. 22, 2012

Related U.S. Application Data

(60) Provisional application No. 61/315,947, filed on Mar. 20, 2010.

(51) Int. Cl.
*A63C 17/01* (2006.01)

(52) U.S. Cl.
CPC ..... *A63C 17/015* (2013.01); *A63C 2203/10* (2013.01)
USPC ..... 280/87.05

(58) Field of Classification Search
CPC ..... A63C 17/015; A63C 2203/10; A63C 17/0006; A63C 17/012; A63C 2203/42; A63C 5/02
USPC ..... 280/87.05, 87.042; 428/12
See application file for complete search history.

(56) References Cited

U.S. PATENT DOCUMENTS

| | | | | |
|---|---|---|---|---|
| 322,504 | A | 7/1885 | Thompson | |
| 329,556 | A | 11/1885 | Hirt | |
| 865,441 | A | 9/1907 | Slocum | |
| 1,186,671 | A | 6/1916 | McKenzie | |
| 2,959,423 | A | 11/1960 | Dornseif | |
| 3,922,018 | A | 11/1975 | Shook | |
| 4,047,725 | A | 9/1977 | Pinchock | |
| 4,251,087 | A | 2/1981 | Hansen | |
| 4,262,918 | A | 4/1981 | Sandino | |
| 4,398,734 | A | 8/1983 | Barnard | |
| 4,786,022 | A | 11/1988 | Grieshaber | |
| 5,319,992 | A | 6/1994 | Shui-Te | |
| 5,383,716 | A | 1/1995 | Stewart et al. | |
| 5,505,474 | A * | 4/1996 | Yeh | 280/87.042 |
| 5,526,661 | A | 6/1996 | Lin | |
| 5,556,222 | A | 9/1996 | Chen | |
| 5,769,438 | A | 6/1998 | Svetlov | |
| 6,131,931 | A | 10/2000 | Globerson et al. | |
| 6,315,304 | B1 | 11/2001 | Kirkland et al. | |
| 6,523,837 | B2 | 2/2003 | Kirkland | |
| 6,663,124 | B1 | 12/2003 | Thompson | |
| 6,793,224 | B2 | 9/2004 | Stratton | |
| D505,470 | S * | 5/2005 | Hong | D21/765 |
| 6,948,878 | B1 | 9/2005 | Smith, Jr. et al. | |
| 6,981,711 | B2 * | 1/2006 | Seta | 280/87.05 |
| 7,007,957 | B1 | 3/2006 | Lee | |
| 7,083,178 | B2 * | 8/2006 | Potter | 280/87.042 |

(Continued)

*Primary Examiner* — J. Allen Shriver, II
*Assistant Examiner* — Brian Cassidy
(74) *Attorney, Agent, or Firm* — Clayton, Howarth & Cannon, P.C.

(57) ABSTRACT

A folding sports board having a first section and a second section separated by a deck joint. A double hinge assembly may interconnect the first section and the second section at the deck joint. At least one tooth member may extend between the first section and the second section. The at least one tooth member may be operable to distribute forces away from the deck joint such that failure at the deck joint may be eliminated or reduced. Sections of the sports board can be easily replaced to customize the board based upon rider preferences or to fix broken sections.

29 Claims, 11 Drawing Sheets

(56) References Cited

U.S. PATENT DOCUMENTS

| | | | | |
|---|---|---|---|---|
| 7,093,842 | B2 | 8/2006 | Chmelar | |
| 7,104,558 | B1 | 9/2006 | Saldana | |
| 7,140,621 | B2 * | 11/2006 | Cheng | 280/11.27 |
| 7,150,461 | B2 | 12/2006 | Schnuckle et al. | |
| 7,390,234 | B2 * | 6/2008 | Peach | 441/74 |
| 7,581,739 | B2 | 9/2009 | Fraley | |
| 7,631,884 | B2 | 12/2009 | Cole | |
| 7,635,137 | B2 | 12/2009 | Gregory et al. | |
| 7,810,825 | B2 | 10/2010 | Cole | |
| 7,828,306 | B2 | 11/2010 | Stratton | |
| 7,837,204 | B1 | 11/2010 | Groenenboom | |
| 7,866,193 | B2 | 1/2011 | Tribout | |
| 7,976,034 | B1 * | 7/2011 | Hong et al. | 280/87.042 |
| 8,079,610 | B2 | 12/2011 | Winefordner et al. | |
| 8,186,768 | B2 | 5/2012 | Spahr | |
| 8,251,383 | B2 | 8/2012 | Dickie | |
| 8,256,983 | B2 | 9/2012 | Lin | |
| 8,261,585 | B2 | 9/2012 | Kotlizky et al. | |
| 8,297,414 | B2 | 10/2012 | Juan | |
| 8,308,172 | B2 | 11/2012 | Gulbranson | |
| 8,328,206 | B2 | 12/2012 | Williams, Jr. | |
| 8,382,134 | B2 | 2/2013 | Bartlett et al. | |
| 2005/0212246 | A1 * | 9/2005 | Hong | 280/87.042 |
| 2007/0035100 | A1 | 2/2007 | Gregory et al. | |
| 2009/0066150 | A1 | 3/2009 | O'Rourke, Sr. | |
| 2010/0123295 | A1 | 5/2010 | Landau | |

* cited by examiner

FOLDING SPORTS BOARD AND TRUCK MOUNTING APPARATUS

CROSS-REFERENCE TO RELATED APPLICATIONS

This application claims the benefit of U.S. Provisional Application No. 61/315,947, filed Mar. 20, 2010, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

BACKGROUND

1. The Field of the Present Disclosure

The present disclosure relates generally to sport equipment, and more particularly, but not necessarily entirely, to folding sports boards.

2. Description of Related Art

Sports boards have long been used for both transportation and pleasure. Sports boards may include wheeled boards such as skateboards and longboards. One disadvantage associated with sports boards is that they are difficult to store and carry due to their length. For example, a student may have difficulty storing a longboard while at class. This disadvantage may deter users from using a skateboard as a form of transportation.

Previously available sports boards have been designed to overcome this disadvantage. For example, previously available sports boards have been designed to fold compactly for storage. However, some of these folding boards do not resemble in construction, look, or feel of traditional sports boards such as the skateboards, snowboards, and other boards they are supposed to replace. Other forms of previously available sports board, while resembling traditional sports boards, cause undue stress on the joints of the boards, or require the use of locking mechanisms, or do not fold as flat or short as needed. In particular, some previously available folding sports boards have forces acting in the same plane as the board deck which causes the hinged edges to press against each other. These forces may cause a failure of the fasteners securing the hinges to the boards. For example, these forces can lead to screws being pulled out. It also can lead to deterioration of hinged edges from increased stress.

Despite the advantages of known sports boards, improvements are still being sought. The prior art is thus characterized by several disadvantages that are addressed by the present disclosure. The present disclosure minimizes, and in some aspects eliminates, the above-mentioned failures, and other problems, by utilizing the methods and structural features described herein.

The features and advantages of the present disclosure will be set forth in the description which follows, and in part will be apparent from the description, or may be learned by the practice of the present disclosure without undue experimentation. The features and advantages of the present disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
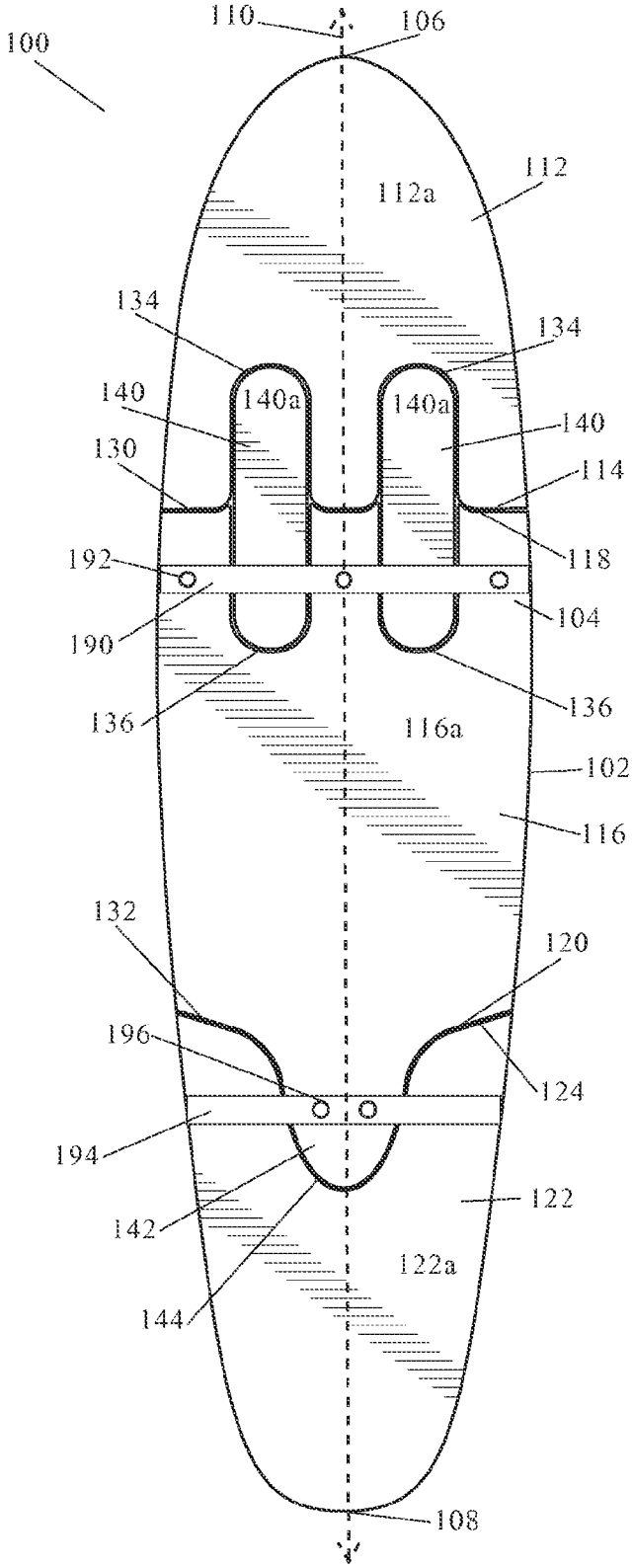
FIG. 1 is a top view of a sports board pursuant to an embodiment of the present disclosure configured in a ready-to-use position.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method steps.

Applicant has discovered a folding sports board, such a skateboard or a longboard. The sports board may include a first section and a second section separated by a deck joint. A double hinge assembly may interconnect the first section and the second section at the deck joint. At least one tooth member may extend between the first section and the second section. The at least one tooth member may be operable to distribute forces away from the deck joint such that failure of the deck joint hinges may be eliminated or reduced.

Referring now to FIG. 1, there is depicted a top view of a folding sports board 100 pursuant to an embodiment of the present disclosure. It will be appreciated that the sports board 100 may be a type of skateboard, such as a long board. The shape of the board 100 may vary, including a tail or nose curved upwards or downwards. The board 100 may be convex or concave or have other configurations such as a "W" (convex and concave altering bends) or it may be convex or concave from tail to nose instead of side to side. As will be explained in more detail herein, hinges may be utilized between board sections to enable the sports board 100 to fold from a ready-to-use-position to a storage position. It will be appreciated that the board 100 may have multiple storage positions.

The sports board 100 may include a deck 102 having a top surface 104. As is known to one having ordinary skill in the art, a rider may stand on the top surface 104 while using the sports board 100. The deck 102 may extend from a nose 106 to a tail 108 along a longitudinal axis 110. The length of the deck 102 from the nose 106 to the tail 108 may vary depending on various factors, including rider preference.

The deck 102 may comprise a first or nose section 112 extending from the nose 102 to a trailing terminal end 114. The deck 102 may further comprise a second or middle section 116 extending from a leading terminal end 118 to a trailing terminal end 120. The deck 102 may further comprise a third or tail section 122 extending from a leading terminal end 124 to the tail 108. The trailing terminal end 114 of the first section 112 and the leading terminal end 118 of the second section 116 may define a front deck joint 130 between the first section 112 and the second section 116. The trailing terminal end 120 of the second section 116 and the leading terminal end 124 of the third section 122 may define a back deck joint 132 between the second section 116 and the third section 122.

The trailing terminal end 114 of the first section 112 may comprise a pair of spaced apart recesses 134 extending parallel to the axis 110 and towards the nose 106 of the first section 112. The leading terminal end 118 of the second section 116 may comprise a pair of spaced apart recesses 136 extending parallel to the axis 110 and towards the tail 108. The pair of spaced apart recesses 134 and the pair of spaced apart recesses 136 may be in alignment with each other. A pair of teeth members 140 may be received into and extend from the recesses 134 in first section 112 to the recesses 136 in the second section 116. The teeth members 140 may be approximately rectangular and parabolic in shape but could be a variety of shapes according to design preferences. Further, the teeth members 140 may be connected or unitary. It will be appreciated that in an embodiment of the present disclosure, the recesses 134 and 136 extend only partially from the top surface of the board 100 to the bottom surface of the board 100. For instance, if the board 100 were made of solid wood, instead of attaching a support to the bottom of the board 100, the recesses in any part of the board 100 may only be cut into half of the thickness of the board 100 such that the support would be part of the board not a separate piece added to the board 100.

The length of the teeth members 140 may also vary depending upon design considerations. As will be discussed in more detail hereinafter, the teeth members 140 may distribute forces away from the deck joint 130 and may provide more or less flexibility in the board 100 depending on rider preference. The distribution of forces away from the deck joint 130 may reduce failures that are common at the deck joint 130, including material failure and fastener pull out.

The trailing terminal end 120 of the second section 116 may comprise a convex portion or tooth member 142. The leading terminal end 124 of the third section 122 may comprise a concave recess 144. The tooth member 142 may be received into in the recess 144 as shown in FIG. 1.

A top surface 112*a* of the first section 112, a top surface 116*a* of the second section 116, a top surface 122*a* of the third section 122, and top surfaces of the 140*a* of the teeth members 140 may be substantially co-planar and collectively define the top surface 104 of the deck 102 while the board 100 is in a ready-to-use position.

Referring to FIG. 1, there is shown optional support 190 attached to the top surface 116*a* of the second section 116. The support 190 may be connected by fasteners 192. The support 190 may be removably attached to the surface 116*a*. When installed, the support 190 may maintain the first section 112 and the second section 116 in the read-to-use configuration by securing the teeth 140 in the recess 136. Also shown is an optional support 194 attached to the top surface 116*a* of the second section 116. The support 194 may be connected by fasteners 196. The support 194 may be removably attached to the surface 116*a*. When installed, the support 194 may maintain the tooth 142 in the recess 144. The configure the board 100 in the storage position, the supports 190 and 194 may be removed or retracted.

Figure 2:
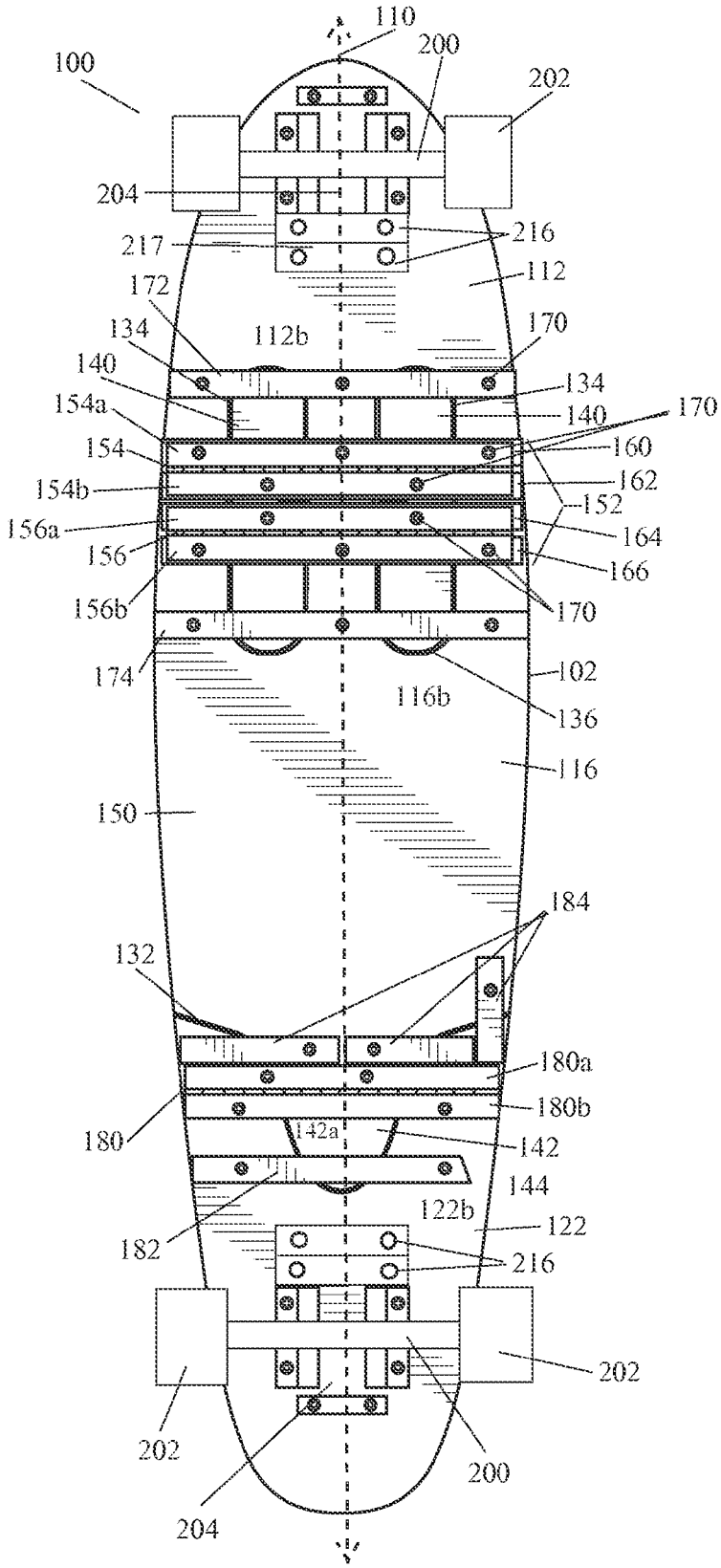
FIG. 2 is a bottom view of the sports board shown in FIG. 1 configured in the ready-to-use position.
Figure 3:
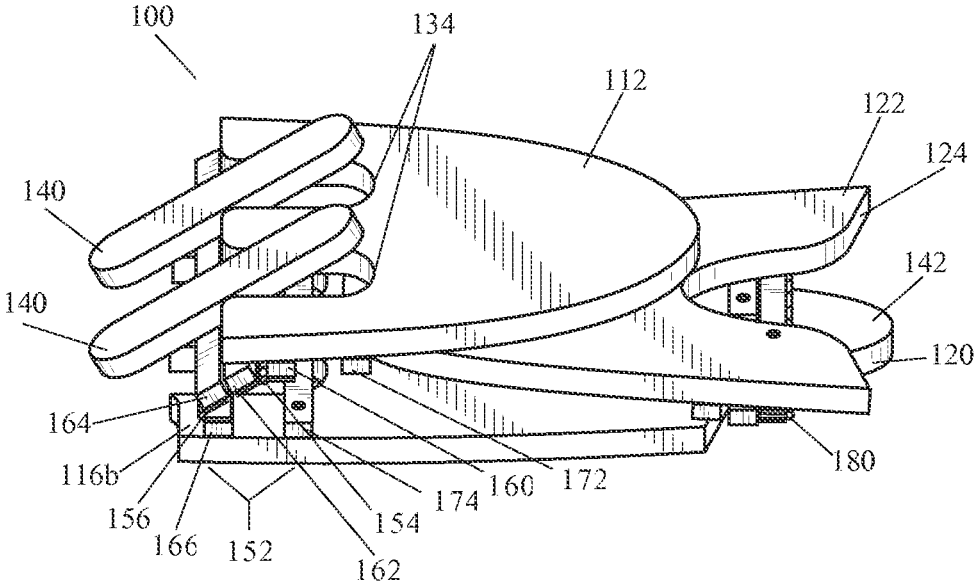
FIG. 3 is a view of the sports board shown in FIG. 1 configured in a folded or storage position.
Figure 6:
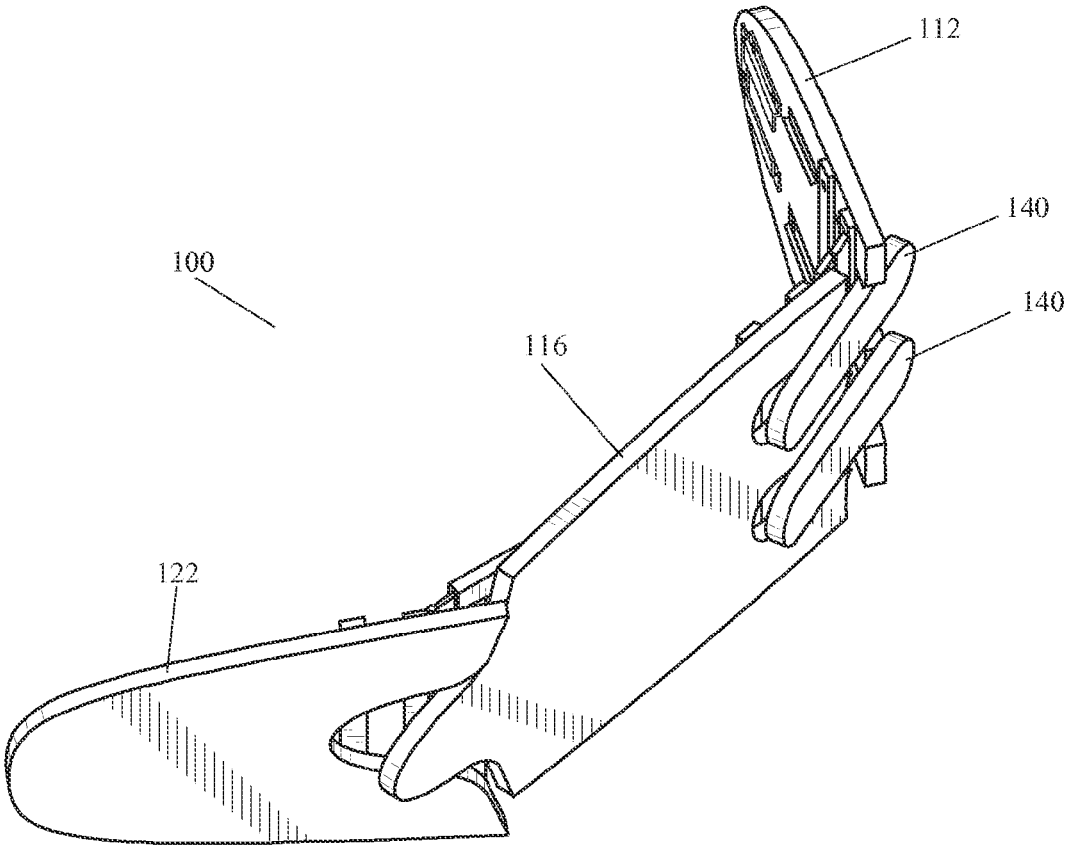
FIG. 6 is a view of sports board shown in FIG. 1 shown in an intermediate position between the ready-to-use position and the storage position.

Referring now to FIGS. 2, 3, and 6, there is depicted a view of a bottom surface 150 of the deck 102 of the sports board 100 shown in FIG. 1, where like reference numerals depict like components. Interconnecting the first section 112 and the second section 116 may be a double hinge assembly 152. The double hinge assembly 152 may comprise a front hinge assembly 154 providing an axis of rotation that extends transversely to the longitudinal axis 110. The double hinge assembly 152 may also comprise a back hinge assembly 156 providing an axis of rotation that extends transversely to the longitudinal axis 110.

A first wing 154*a* of the front hinge assembly 154 may be coupled using fasteners 170 to a support member 160 extending transversely to the longitudinal axis 110. The support member 160 may be coupled to the bottom surface 112*b* of the first section 112. The support member 160 may span across the recesses 134 of the first section 112. A second wing 154*b* of the front hinge assembly 154 may be connected to a support member 162, which is not connected directly to either the first section 112 or the second section 116. In an embodiment of the present disclosure, the support members 160 and 162 may be mounted to the opposite side of the wings 154*a* and 154*b*.

A first wing 156*a* of the back hinge assembly 156 may be coupled using fasteners 170 to a support member 164 extending transversely to the longitudinal axis 110. The support member 164 may not be coupled directly to either the first section 112 or the second section 116. A second wing 156*b* of the back hinge assembly 156 may be connected to a support member 166. The support member 166 may be coupled to the second section 116. The support member 166 may span across the recesses 136 of the second section 116. In an embodiment of the present disclosure, the support members 164 and 166 may be mounted to the opposite side of the wings 156*a* and 156*b*.

The pair of teeth members 140, or just a single tooth member, may be coupled to the supports 162 and 164 such that they may move with respect to both the first section 112 and the second section 114. The teeth members 140 may include cantilevered portions both in front of the support 162 and behind the support 164. The supports 162 and 164 may be referred to herein collectively as a "support member."

It will be appreciated that any of the supports described herein may be placed on top of the board 100. Further, the supports disclosed herein may be integrated into the design of the board 100.

A first stop or support member 172 may extend transversely to the longitudinal axis 110 and across a front portion of the recesses 134 in the first section 112. A second stop or support member 174 may extend transversely to the longitudinal axis 110 and across a rear portion of the recesses 136 in the second section 116. The first stop member 172 and the second stop member 174 may engage a bottom surface 140*b* of the cantilevered portions of the teeth members 140 to thereby stop rotation of the first section 112 with regard to the first hinge assembly 154 and the second section 116 with regard to the second hinge assembly 156. The stop members 172 and 174 may also received forces distributed away from the deck joint 130 (see FIG. 1) via the teeth members 140.

In an embodiment of the present disclosure, the support members 174 and 166 may be formed from a unitary or solid piece of material. In an embodiment of the present disclosure, the support members 160 and 172 may be formed from a unitary or solid piece of material. In an embodiment of the present disclosure, the support members 164 and 162 may be formed from a unitary or solid piece of material.

Joining the second section 116 and the third section 122 may be a hinge assembly 180. A forward wing 180*a* of the hinge assembly 180 may be connected to the tooth 142. A rear wing 180*b* of the hinge assembly 180 may be connected to a bottom surface 122*b* of the third section 122. In an embodiment of the present disclosure, the wings 180*a* and 180*b* may be mounted on supports that are mounted either above or below the wings 180*a* and 180*b*. A support or stop 182 may extend across the recess 144 such that it can engage a bottom surface 142*a* of the tooth member 142 formed in the second section 116. Supports or stops 184 may extend laterally from the tooth 142 to thereby engage the bottom surface 122*b* of the third section 122. Supports or stops 184 may be formed from a unitary or solid piece of material. It will be appreciated that the tooth 142, recess 144 and supports 182 and 184 operate to distribute forces away from the deck joint 132 and the hinge assembly 180. It will be appreciated that the support 182 and a support under 180*b* may be formed from a unitary or solid piece of material.

As perhaps best observed in FIG. 3, the axis of rotation of the first hinge assembly 154 is offset from the bottom surface 112*b* (FIG. 2) of the first section 112 in an amount that is equal to or greater than the thickness of the support member 162. Likewise, the axis of rotation of the second hinge assembly 156 is offset from the bottom surface 116*b* of the second section 116 in an amount that is equal to or greater than the thickness of the support member 164.

In an embodiment of the present disclosure, the support members 162 and 164 may be unitary, e.g., formed from a single piece of material. In an embodiment of the present disclosure, the wing 154*b* of the first hinge assembly 154 and the wing 156*a* of the second hinge assembly 156 may be interconnected or of unitary construction. In an embodiment of the present disclosure, the axis of rotation of the first hinge assembly 154 is offset toward the nose 106 of the first section 112 such that it does not lie directly beneath the deck joint 130. In an embodiment of the present disclosure, the axis of rotation of the second hinge assembly 156 is offset toward the tail 108 such that it does not lie directly beneath the deck joint 130.

It will be appreciated that the use of the pair of teeth members 140 will distribute forces that would otherwise weaken the double hinge assembly 152. In particular, the teeth members may distribute the forces forwardly and rearwardly from the deck joint 130 to the supports 172 and 174, respectively. Thus, it will be appreciated that the structure and apparatus disclosed herein is merely one example of a means for distributing forces away from the deck joint between the first section and the second section, and it should be appreciated that any structure, apparatus or system for distributing forces away from the deck joint between the first section and the second section which performs functions the same as, or equivalent to, those disclosed herein are intended to fall within the scope of a means for distributing forces away from the deck joint between the first section and the second section, including those structures, apparatus or systems for distributing forces away from the deck joint between the first section and the second section which are presently known, or which may become available in the future. Anything which functions the same as, or equivalently to, a means for distributing forces away from the deck joint between the first section and the second section falls within the scope of this element.

In an embodiment of the present disclosure, the sports board 100 may be configured between a ready-to-use position as shown in FIGS. 1 and 2, and a storage position as shown in FIG. 3. An intermediate position between the ready-to-use position and the storage position is depicted in FIG. 6. In the ready-to-use position, wheel truck assemblies may be attached to the bottom surface of the board 100 and a rider may stand or ride on the deck 102. It will be appreciated that the board 100 may remain in the ready-to-use position due to the natural weight of the board 100 when so deployed.

It will be appreciated that in an embodiment of the present disclosure, no locking mechanisms may be necessary to maintain the sports board 100 in the ready-to-use position. This may be advantageous as it may allow for maneuvers that cannot be performed while the board 100 is locked. In addition, a non-locking board also provides the functional operation of slowing the rider down by making part of the board or a part connected to the board come in contact with the ground by putting the board it in a non-open position while in motion. In an embodiment of the present disclosure, the present invention may include a locking mechanism to maintain a sports board 100 in a ready-to-use configuration.

It will be appreciated that the use of the double hinge assembly 152 may allow the sports board 100 to be folded flatter and shorter when configured to the storage position. Further, the sports board 100 may be locked inside of a locker when folded. Further, the modular nature of the sports board 100 allows damaged sections to be simply replaced instead of discarding an entire board. In an embodiment of the present disclosure, one or more of the first section 112, and the second section 116 and the third section 122 may be removed to thereby reduce the overall length of the board 100. That is, the board 100 may be reduced to two sections. The board 100 may include various artistic cutouts and designs. In an embodiment of the present disclosure, the board 100 may include only two sections jointed together by a double hinge assembly 152 or a single hinge assembly 180.

The components of the sports board 100 described herein may be constructed from a wide variety of suitable materials, including, without limitation, metal, plywood, solid wood, carbon fiber, plexiglass, composites, fiberglass, styrofoam, cardboard, foam core or honeycomb core (as is used in many types of carbon fiber), or any other suitable material or combinations thereof. The sports board 100 may include a foam core or other types of core material as is common to surf boards, paddle boards, and other water sport boards. In an embodiment of the present disclosure, one or both of the pair of teeth members may be constructed of different materials having different degrees of stiffness or flexibility. It will be appreciated that such a construction may allow different turning characteristics for a rider's toe-side turns and heel-side turns. Further, the materials of the first section 112, the second section 116, and the third section 122 may be varied to change the ride characteristics, such as the flexibility of the board 100.

For example, varying the components of the board 100 may allow a rider of the board to specialize each section of the board to perform a specific purpose and cater the overall board to the rider. For example, some longboard riders are better at turning to one side of the board 100 as compared to the other. A rider with his body facing to the left with respect to the nose of the board 100 may be better at performing toe-side turns. In this case, a stiff material may be utilized for the left tooth 140. However, the rider may not be as skilled at performing a heel side (right side) turns, so a less stiff material could be utilized for the right tooth 100 of the board. The decreased stiffness allows the rider to turn to the right just as easily as a turn to the left. This can be very advantageous in the races that some longboarders participate in. Another example is that depending on the tooth configuration used by the rider it may be advantageous to make all of the teeth or supports out of stiffer material since there is not as much of this material (typically—not always the case) as there is of regular board material. Further, having small tough teeth 140 could give the rider the same feel as big soft teeth but use less space. Also, having teeth 140 that are thicker or skinnier than other parts of the board 100 could be useful for foot placement, feel of the board, or grip. One benefit of different materials may allow board riders to avoid some problems that board riders face, such as "speed wobbles" (when riders go faster the board begins to wobble underneath them) or change the frequencies that the board experiences at different speeds.

In an embodiment of the present disclosure, the hinge assembly 154 may be positioned about one-third of the length of the board 100 as measured from the nose 106. The hinge assembly 156 may be placed at a distance from the hinge assembly 154 that is approximately equal to the thickness of the board 100 plus the thickness of any wheel truck attachment structures, including "risers" as is known to one having ordinary skill in the art. The hinge assembly 180 may be positioned about one-third of the length of the board 100 as measured from the tail 108. In an embodiment of the present disclosure, any number of hinges and sections may be utilized such that the board 100 may fold or roll-up into a compact storage position. For example, in order to allow for different storage configurations of the sports board 100, more than three sections may exist where each section is joined by a single or double hinge with tooth assembly distributing forces away from the joint. As more and more sections are added to the board the size of each section is smaller. The addition of new sections also allows for a configuration that approximates more and more closely a circular shape. To illustrate, three sections may allow for a triangle configuration, four sections may allow for a square, five sections a pentagon, etc. This pattern continues until the shape is approximately circular. The more sections, the smaller each section and the more that the end shape can represent a circle. Eventually, the sections would be small enough to allow for a board to be rolled up, almost like a mat.

Referring now back to FIG. 2, attached to the bottom surface 112*b* of the first section 112 and the bottom surface 122*b* of the third section 112 may be a pair of wheel truck assemblies 200. The truck assemblies 200 may each have a pair of wheels 202 attached to a planar base member 204.

Figure 4:
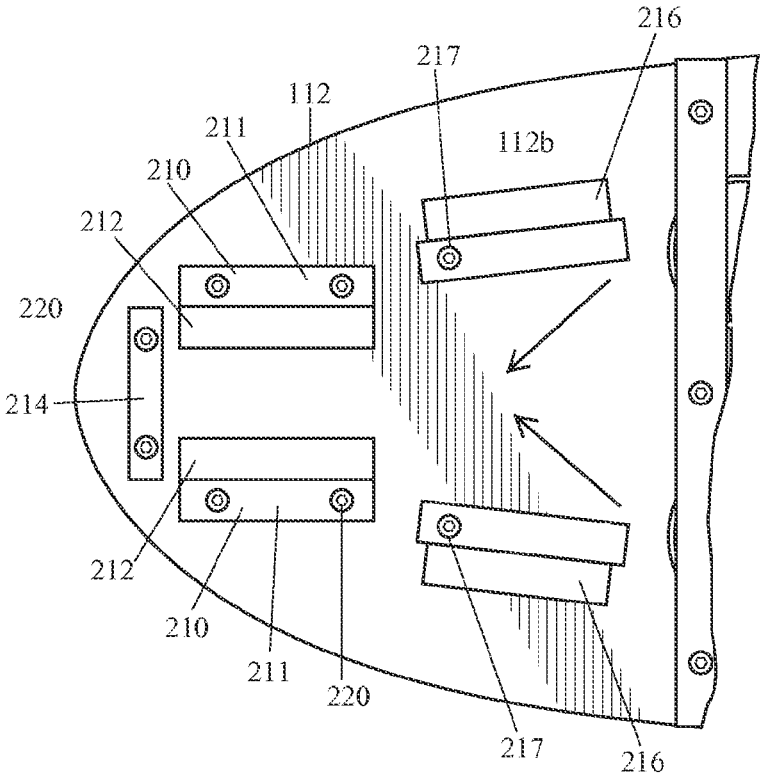
FIG. 4 is a view of a mount for removably mounting a wheel truck assembly to a sports board.
Figure 5:
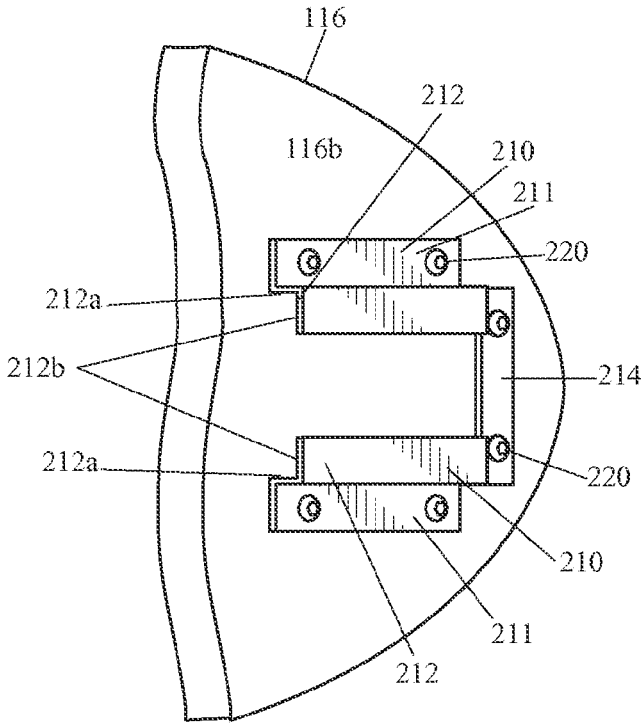
FIG. 5 is a view of a mount for removably mounting a wheel truck assembly to a sports board.

Referring now to FIGS. 4 and 5, the bottom surfaces 112*b* and 116*b* may have mounted thereto a pair of spaced apart brackets 210. The overall shape of the brackets 210 may be Z-shaped. As perhaps best seen in FIG. 5, each of the pair of brackets 210 may include an L-shaped portion 212 defining a slot for receiving a planar base member 204 (FIG. 2) of one of the truck assemblies 200 (FIG. 2). Still referring to FIG. 5, each slot may include a pair of opposing surfaces 212*a* extending perpendicularly from the bottom surface 116*b*. The distance between the opposing surfaces 212*a* is just wider than the width of the base member 204. Extending inwardly at the top of the opposing surfaces 212*a* may be surfaces 212*b*. The surfaces 212*b* may be parallel to the bottom surface 116*b*. Fasteners 220 may be utilized to attach flanges 211 of the brackets 210 to the bottom surfaces 112*b* and 116*b*.

Referring again to FIGS. 4 and 5, stops 214 mounted to the bottom surfaces 112*b* and 116*b* may engage a front edge of a planar base member 204 to thereby stop movement of the member 204. The stops 214 may be secured using fasteners 220. A pair of pivotally mounted gate members 216 may close as shown in FIG. 2 to thereby lock the planar base members 204 in the slots formed by the brackets 210. The gate members 216 may pivot around a pivot point 217. Fasteners may be utilized to secure the gate members 216 in a closed or open position. The fasteners may include wing nuts or a window lock type mechanism to allow quick installation and removal of the wheel truck assemblies 200. In an embodiment of the present disclosure, the brackets 210 may clamp the base members 204 in place against the bottom surfaces 112*b* and 116*b* by tightening the fasteners holding the brackets 210 in place.

In an embodiment of the present disclosure, a graduated sloped surface may be utilized in conjunction with the brackets 210. In particular, a graduated sloped surface may increase the friction or pressure between the brackets 210 and the base members 204. For example, the graduated sloped surface may cause the height of the slot into which the base members 204 are inserted to decrease until the height is just less than the thickness of the base members 204. The graduated sloped surface may extend from a bracket 210 or from the bottom surfaces 112*b* and 122*b*.

Figure 7:
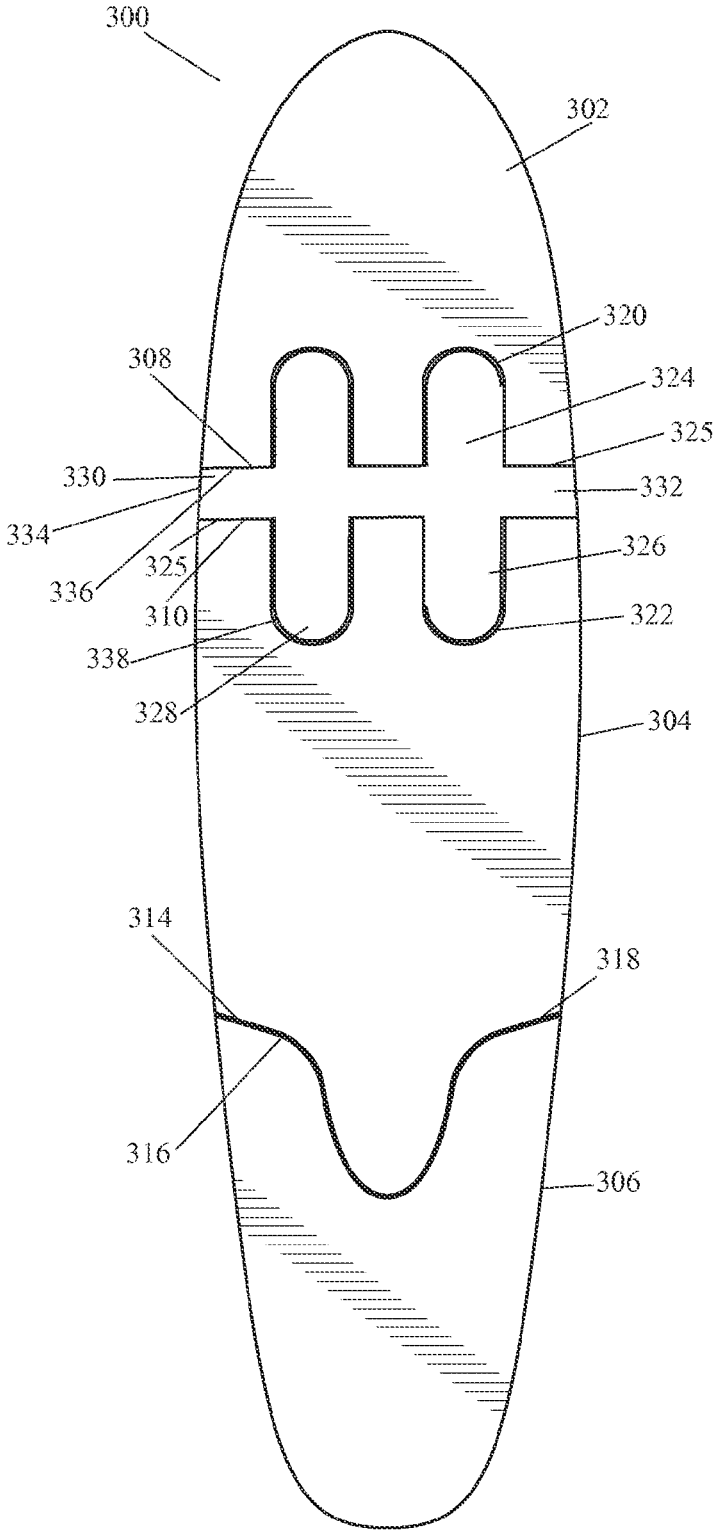
FIG. 7 is a top view of a sports board pursuant to an embodiment of the present disclosure configured in a ready-to-use position.

Referring now to FIG. 7, there is depicted a sports board 300 pursuant to an embodiment of the present disclosure. The sports board 300 may include a front or first section 302, a middle or second section 304, and a rear or third section 306. Interposed between the first section 302 and the second section 304 may be a tooth member 324. The tooth member 324 may comprise a pair of teeth 326 and 328 similar in nature to the teeth 140 described above. The tooth member 324 may further comprise a cross-piece member 330 connected to the teeth 326 and 328 and extending to the lateral sides 332 and 334 of the board 300.

A trailing terminal end 308 of the first section 302 and a leading terminal end 336 of the tooth member 324 may define part of a front deck joint 325 between the first section 302 and the second section 304. A trailing terminal end 338 of the tooth member 324 and a leading terminal end 308 of the second section 304 may define part of the front deck joint 325 between the first section 302 and the second section 304. A trailing terminal end 314 of the second section 304 and the leading terminal end 316 of the third section 306 may define a back deck joint 318 between the first section 304 and the second section 306.

A recess 320 may be formed in the trailing terminal end 308 of the first section 302. A recess 322 may also be formed in the leading terminal end 310 of the second section 304. The recesses 320 and 322 may be shaped to receive the H-shaped tooth member 324. Although not explicitly shown, the H-shaped tooth member 324 may be attached to a double hinge assembly as described in relation to FIG. 2 above. The tooth member 324 may be operable to distribute forces away from the deck joint 325 as described above.

Figure 8:
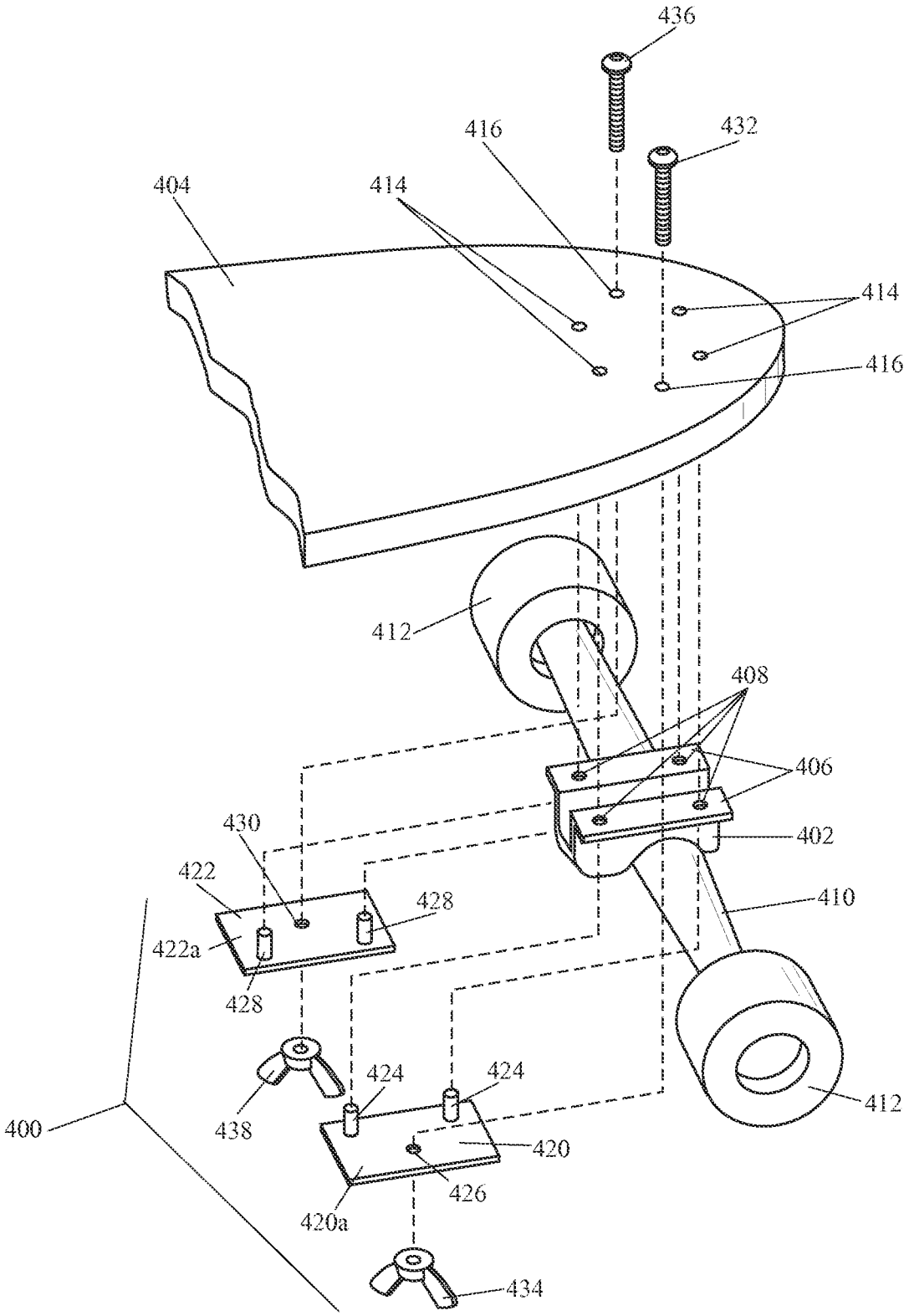
FIG. 8 is an exploded view of an embodiment of a wheel truck mounting assembly.

Referring now to FIG. 8, there is depicted an exploded view of a wheel truck mounting assembly 400 for mounting a truck 402 to a deck 404. The truck 402 may comprise a baseplate 406 having bores 408 formed therein. Connected to the baseplate 406 may be hanger 410 having an axle for mounting wheels 412 as is known to one having ordinary skill in the art. A plurality of bores 414 formed in the deck 404 may conform in configuration to the bores 408 in the baseplate 406. That is, the bores 414 and the bores 408 may be in alignment with each other. Bores 416 may also be formed in the deck 404 and may be outside of the footprint of the baseplate 406.

The mounting assembly 400 may comprise a first plate 420 and a second plate 422. Extending from a top surface 420*a* of the first plate 420 may be a pair of posts 424. A bore 426 may also be formed in the first plate 420. Likewise, extending from a top surface 422*a* of the second plate 422 may be a pair of posts 428. A bore 430 may also be formed in the second plate 420. It will be appreciated that the bore 426 may align with one of the bores 416 and that the bore 430 may align with the other one of the bores 416.

To mount the truck 402, the posts 424 of the first plate 420 may be inserted through bores 408 on one side of the baseplate 406 and into the corresponding bores 414 in the deck 404. The posts 428 of the second plate 422 may be inserted through bores 408 on the other side of the baseplate 406 and into the corresponding bores 414 in the deck 404.

A threaded shaft of a fastener 432 may then be installed through one of the bores 416 and through the bore 426 in the first plate 420. A wing nut 434 may be threaded onto the shaft of the fastener 432 and tightened in order to clamp the baseplate 406 to the bottom side of the deck 404 using the plate 420. Similarly, a threaded shaft of a fastener 436 may then be installed through the other one of the bores 416 and through the bore 430 in the second plate 422. A wing nut 438 may be threaded onto the shaft of the fastener 436 and tightened in order to clamp the baseplate 406 to the bottom side of the deck 404 using the plate 422. In this manner, the wheel truck 402 may be removably mounted to the deck.

Figure 9:
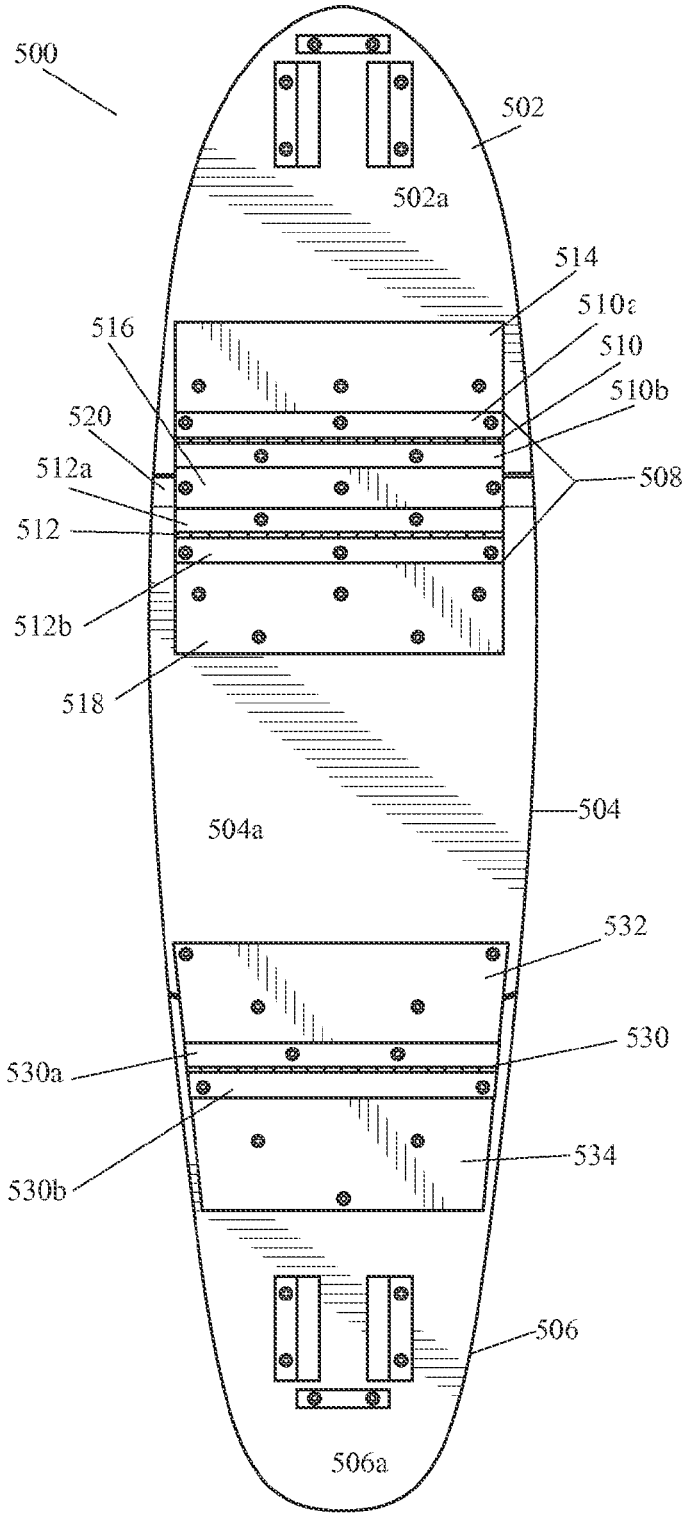
FIG. 9 is a bottom view of a sports board according to an embodiment of the present disclosure.
Figure 10:
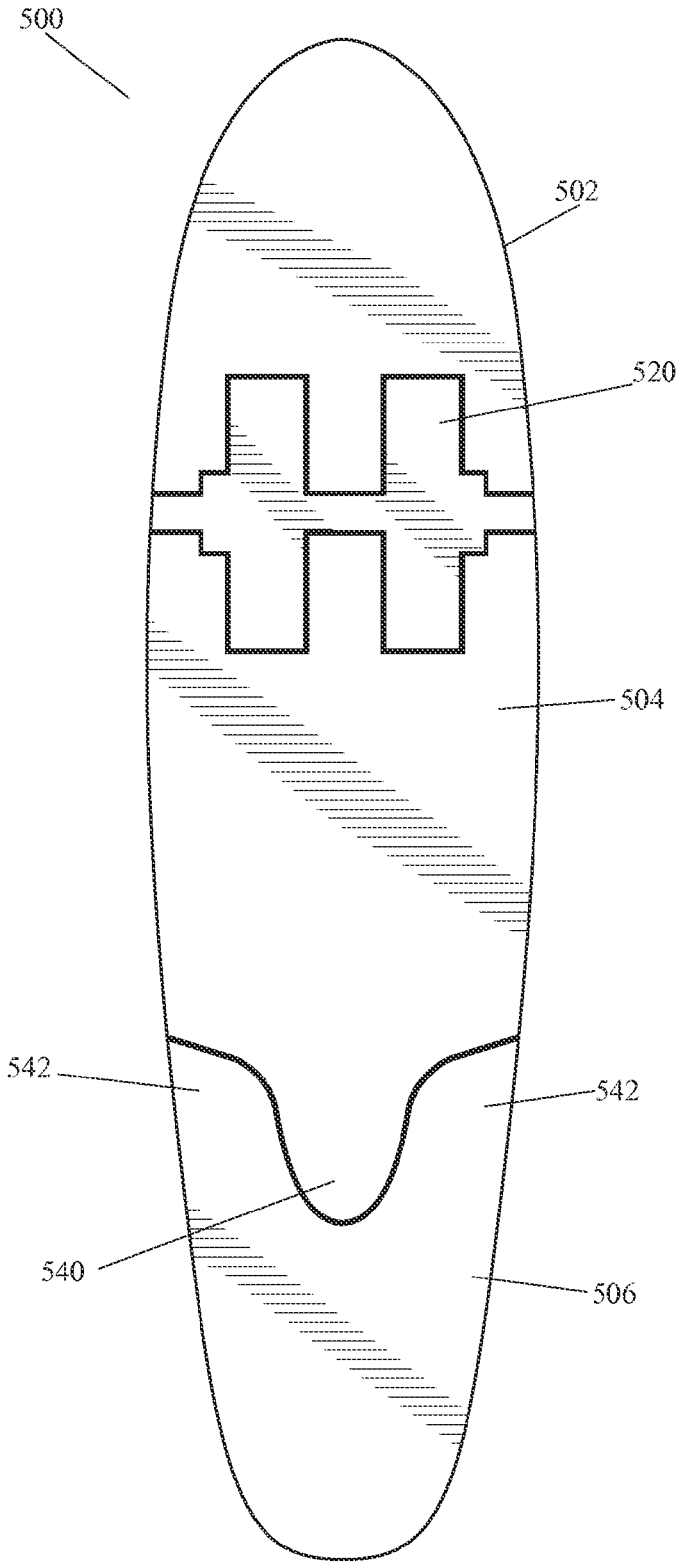
FIG. 10 is a top view of the sports board shown in FIG. 9.

Referring now to FIGS. 9-12, there is depicted a board 500 pursuant to an embodiment of the present disclosure. As best seen in FIG. 9, the board 500 may comprise a first section 502, a second section 504, and a third section 506. The first section 502 and the second section 504 may be interconnected by a double hinge assembly 508. The double hinge assembly 508 may comprise a first hinge 510 and a second hinge 512.

A wing 510*a* of the hinge 510 may be fastened to a support 514. The support 514 may be secured to an underside 502*a* of the first section 502 by fasteners. A wing 510*b* may be connected to a support 516. A wing 512*a* of the hinge 512 may be connected to the support 516. In an embodiment of the present disclosure, the wings 510*b* and 512*a* may be formed of a unitary or solid material. A wing 512*b* may be connected to a support 518 which is secured to an underside 504*a* of the second section 504. The support 516 may be secured to a tooth member 520.

Figure 11:
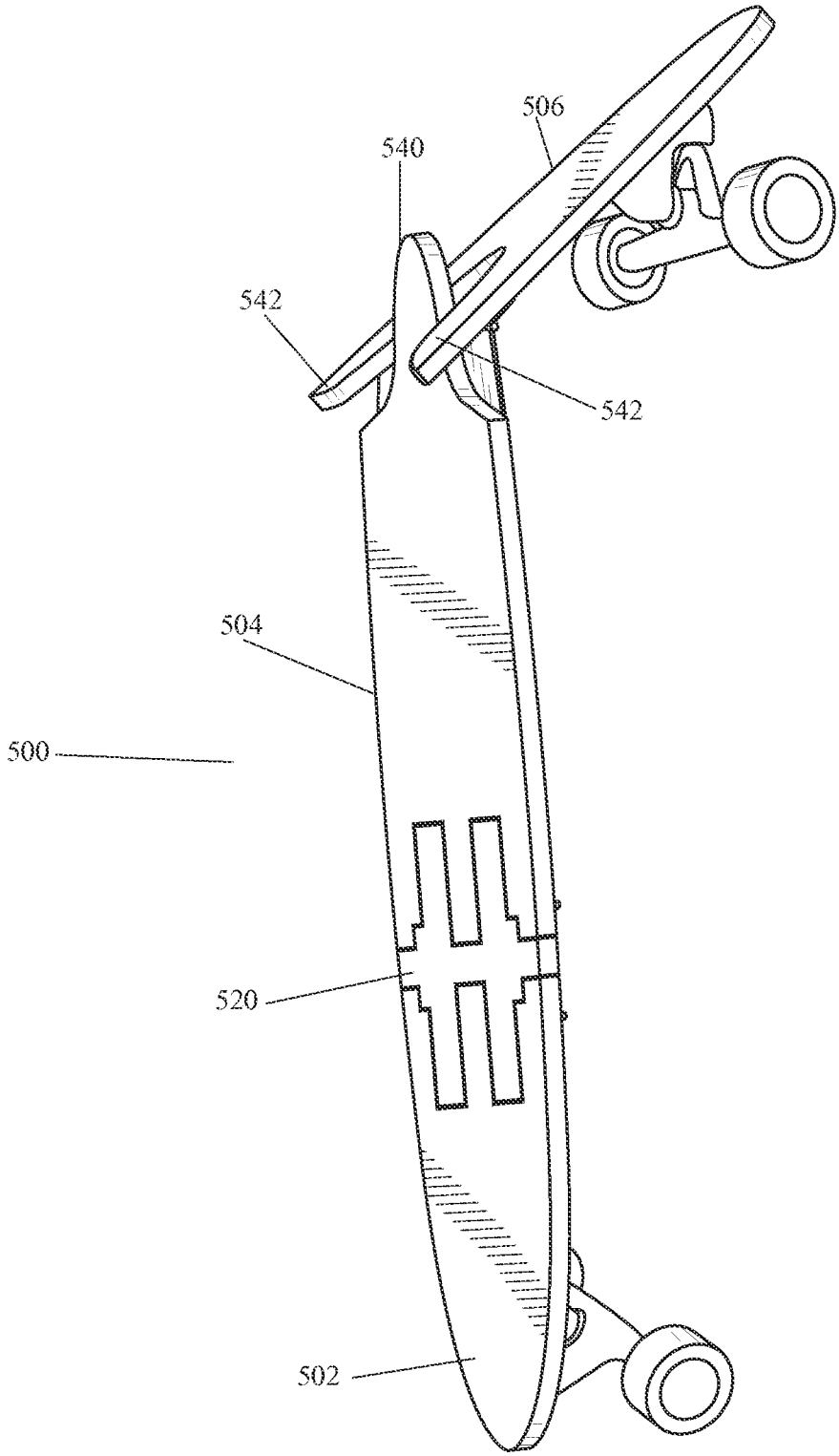
FIG. 11 is a view of the sports board shown in FIG. 9 configured to a maneuvering position.

The second section 504 and the third section 506 may be connected by a hinge 530. A wing 530*a* of the hinge 530 may be connected to a support 532 which is connected to a bottom surface 504*a* of the second section 504. A wing 530*b* of the hinge 530 may be connected to a support 534 which is secured to a bottom surface 506*a* of the third section. It will be appreciated that the supports 514, 516, 518, 532 and 534 may take the form of a metal plate. The support 514 may arrest or stop movement of the tooth member 520 with respect to the first hinge 510. The support 518 may arrest or stop movement of the tooth member 520 with respect to the second hinge 512. The support 534 may arrest or stop movement of the second section 504 with respect to the hinge 530. The support 532 may arrest or stop movement of the third section 506 with respect to the hinge 530. The double hinge assembly 508 and the hinge 530 may have forces distributed away from them by the tooth member 520 and the tooth member 540 and teeth members 542, receptively. As best seen in FIG. 11, the board 500 can be configured as shown while in use as shown at the behest of a skilled rider.

Figure 12:
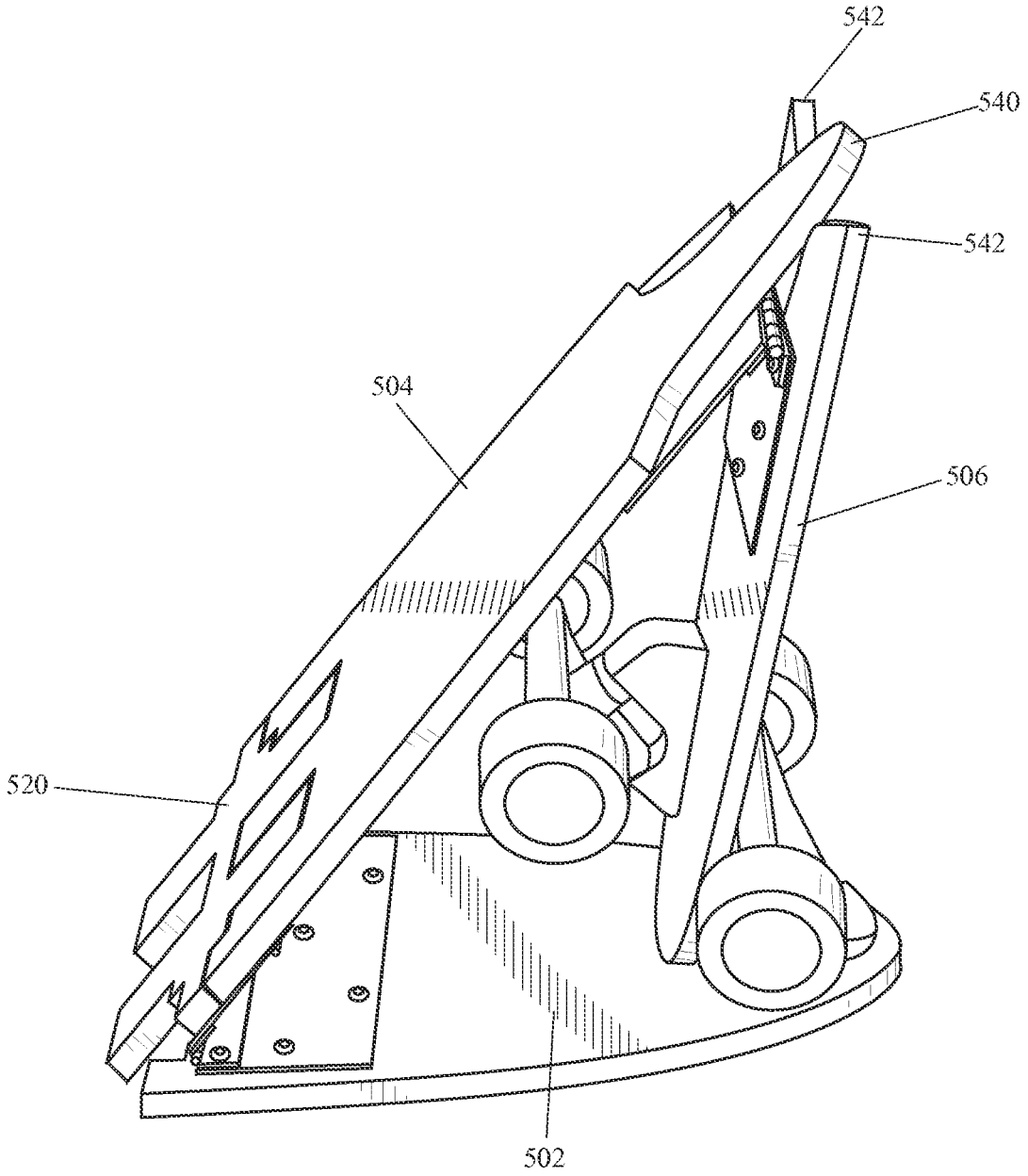
FIG. 12 is a view of the sports board shown in FIG. 9 configured to a storage position.

As best seen in FIG. 12, the board 500 may be configured to a storage position as shown. The storage position shown in FIG. 12 is useful because the wheels do not have to be removed but it can still fit in many cube shaped lockers. Also, in this position, the board 500 can fit under desks or other place a large board can not. Plus it has the additional benefit of being stored in a way that the wheels are not touching the ground, therefore the board 500 will not roll around.

Those having ordinary skill in the relevant art will appreciate the advantages provided by the features of the present disclosure. For example, it is a feature of the present disclosure to provide a folding sports board with removably attachable wheel truck assemblies. Another feature of the present disclosure to provide such a double hinge assembly for allowing a sports board to fold more compactly. It is a further feature of the present disclosure, in accordance with one aspect thereof, to provide a means for distributing forces away from a joint of a folding sports board.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A folding sports board, comprising:

a deck, said deck having a first section and a second section configurable between a first position and a second position;

a pair of wheel truck assemblies attached to a bottom surface of the deck;

each of the first section and the second section having a top surface, a bottom surface, and a terminal end, the terminal ends of the first section and the second section collectively defining a deck joint between the first section and the second section;

at least one recess formed in the terminal end of each of the first section and the second section of the deck;

at least one tooth member;

a first hinge assembly connecting the at least one tooth member to the first section of the deck; and a second hinge assembly connecting the at least one tooth member to the second section of the deck;

wherein the at least one tooth member is received into the at least one recess of the first section and is received into the at least one recess of the second section when said first section and said second section are configured in the first position;

wherein said at least one tooth member comprises a top surface, wherein the top surface of the at least one tooth member, the first section, and the second section form a top surface of the deck when said first section and said second section are configured in the first position.

2. The folding sports board of claim 1, wherein said first section of the deck further comprises a support for arresting movement of the at least one tooth member with respect to the first hinge assembly.

3. The folding sports board of claim 2, wherein said second section of the deck further comprises a support for arresting movement of the at least one tooth member with respect to the second hinge assembly.

4. The folding sports board of claim 1, further comprising a support member interposed between said first hinge assembly and the at least one tooth member and the support member interposed between said second hinge assembly and the at least one tooth member.

5. The folding sports board of claim 4, wherein said support member comprises a top surface, wherein the bottom surface of one of the first section and the second section abuts against the top surface of the support member when said first section and said second section are configured in the first position.

6. The folding sports board of claim 1, wherein the top surfaces of the at least one tooth member, the first section, and the second section are co-planar when said first section and said second section are configured in the first position.

7. The folding sports board of claim 1, wherein the top surfaces of the first section and the second section are substantially parallel when said first section and said second section are configured in the second position.

8. The folding sports board of claim 1, wherein the top surface of the at least one tooth member is co-planar with at least one of the top surfaces of the first and second sections when said first section and said second section are configured in the second position.

9. The folding sports board of claim 1, wherein the top surface of the at least one tooth member is parallel with another tooth member.

10. The folding sports board of claim 1, wherein the pair of wheel truck assemblies are removably attachable to the bottom surface of the deck.

11. The folding sports board of claim 1, wherein the at least one recess comprises two recesses and the at least one tooth comprises two teeth.

12. The folding sports board of claim 1, wherein the at least one tooth comprises an H-shaped member.

13. The folding sports board of claim 1, wherein the deck further comprises a third section, wherein said second section and said third section are joined together by a third hinge assembly such that the second and third sections are configurable between a first position and a second position.

14. The folding sports board of claim 13, wherein the second section comprises an integral tooth member extending therefrom and the third section comprises a recess, wherein said tooth member of the second section is received into said recess of the third section when said second section and the third section are configured to the first position.

15. The folding sports board of claim 14, further comprising a support for arresting movement of the tooth member with respect to the third hinge assembly.

16. A folding sports board having a longitudinal axis, comprising:

a deck, said deck having a first section and a second section configurable between a first position and a second position;

each of the first section and the second section having a top surface, a bottom surface, and a terminal end, the terminal ends of the first section and the second section collectively defining a deck joint between the first section and the second section;

a double hinge assembly connecting the first section and the second section, said double hinge assembly providing a first hinge and a second hinge, both the first and second hinges extending transversely with respect to the longitudinal axis of the folding sports board; and a support member, wherein said support member has a top surface engaging the bottom surface of at least one of the first section and the second section when said first section and the second section are configured in the first position;

wherein said first hinge is offset from the bottom surface of the first section, wherein said second hinge is offset from the bottom surface of the second section, wherein said support member further comprises a thickness, wherein said offset of the first hinge and said offset of the second hinge is equal to or greater than the thickness of the support member; and at least one tooth member coupled to the support member, said at least one tooth member having a top surface, wherein said top surfaces of the tooth member, the first section, and the second section form a top surface of the deck when said first section and said second section are configured in the first position.

17. The folding sports board of claim 16, wherein the top surfaces of the tooth member, the first section, and the second section are substantially co-planar when said first section and said second section are configured in the first position.

18. The folding sports board of claim 16, further comprising at least one recess formed in each of the terminal ends of the first section and the second section, wherein said at least one tooth member is configured and adapted to be received into each of said at least one recesses when said first section and said second section are configured in the first position.

19. The folding sports board of claim 18, further comprising a pair of spaced apart support members, one of said support members extending across the at least one recess formed in the first section and the other support member extending across the at least one recess formed in the second section, wherein said support members engage a bottom surface of the at least one tooth member when said first section and said second section are configured in the first position.

20. The folding sports board of claim 16, wherein said support member resides beneath the deck joint when said first section and the second section are configured in the first position.

21. The folding sports board of claim 16, further comprising a pair of wheel truck assemblies attached to a bottom surface of the deck.

22. The folding sports board of claim 21, wherein the pair of wheel truck assemblies are removably attachable to the bottom surface of the deck.

23. The folding sports board of claim 16, wherein the deck further comprises a third section, wherein said second section and said third section are joined together by a hinge assembly such that the second and third sections are configurable between a first position and a second position.

24. The folding sports board of claim 23, wherein the second section comprises a tooth member and the third section comprises a recess, wherein said tooth member of the second section is received into said recess of the third section when said second section and the third section are configured to the first position.

25. The folding sports board of claim 16, wherein said first hinge is offset from the terminal end of the first section and wherein said second hinge is offset from the terminal end of the second section.

26. A folding sports board, comprising:

a deck, said deck having a first section and a second section configurable between a first position and a second position;

each of the first section and the second section having a top surface, a bottom surface, and a terminal end, the terminal ends of the first section and the second section collectively defining a deck joint between the first section and the second section;

at least one recess formed in the terminal end of each of the first section and the second section of the deck;

at least one tooth member;

a first hinge assembly connecting the at least one tooth member to the first section of the deck;

a second hinge assembly connecting the at least one tooth member to the second section of the deck; and a support member interposed between said first hinge assembly and the at least one tooth member and the support member interposed between said second hinge assembly and the at least one tooth member;

wherein the at least one tooth member is received into the at least one recess of the first section and is received into the at least one recess of the second section when said first section and said second section are configured in the first position;

wherein said at least one tooth member comprises a top surface, wherein the top surface of the at least one tooth member, the first section, and the second section form a top surface of the deck when said first section and said second section are configured in the first position.

27. A folding sports board, comprising:

a deck, said deck having a first section and a second section configurable between a first position and a second position;

each of the first section and the second section having a top surface, a bottom surface, and a terminal end, the terminal ends of the first section and the second section collectively defining a deck joint between the first section and the second section;

at least one recess formed in the terminal end of each of the first section and the second section of the deck;

at least one tooth member;

a first hinge assembly connecting the at least one tooth member to the first section of the deck; and a second hinge assembly connecting the at least one tooth member to the second section of the deck;

wherein the at least one tooth comprises an H-shaped member;

wherein the at least one tooth member is received into the at least one recess of the first section and is received into the at least one recess of the second section when said first section and said second section are configured in the first position;

wherein said at least one tooth member comprises a top surface, wherein the top surface of the at least one tooth member, the first section, and the second section form a top surface of the deck when said first section and said second section are configured in the first position.

28. A folding sports board, comprising:

a deck, said deck having a first section and a second section configurable between a first position and a second position;

each of the first section and the second section having a top surface, a bottom surface, and a terminal end, the terminal ends of the first section and the second section collectively defining a deck joint between the first section and the second section;

at least one recess formed in the terminal end of each of the first section and the second section of the deck;

at least one tooth member;

a first hinge assembly connecting the at least one tooth member to the first section of the deck; and a second hinge assembly connecting the at least one tooth member to the second section of the deck;

wherein the at least one tooth member is received into the at least one recess of the first section and is received into the at least one recess of the second section when said first section and said second section are configured in the first position;

wherein said at least one tooth member comprises a top surface, wherein the top surface of the at least one tooth member, the first section, and the second section form a top surface of the deck when said first section and said second section are configured in the first position;

wherein the deck further comprises a third section, wherein said second section and said third section are joined together by a third hinge assembly such that the second and third sections are configurable between a first position and a second position;

wherein the second section comprises an integral tooth member extending therefrom and the third section comprises a recess, wherein said tooth member of the second section is received into said recess of the third section when said second section and the third section are configured to the first position.

29. A folding sports board having a longitudinal axis, comprising:

a deck, said deck having a first section and a second section configurable between a first position and a second position;

each of the first section and the second section having a top surface, a bottom surface, and a terminal end, the terminal ends of the first section and the second section collectively defining a deck joint between the first section and the second section;

a double hinge assembly connecting the first section and the second section, said double hinge assembly providing a first hinge and a second hinge, both the first and second hinges extending transversely with respect to the longitudinal axis of the folding sports board; and a support member, wherein said support member has a top surface engaging the bottom surface of at least one of the first section and the second section when said first section and the second section are configured in the first position;

wherein the deck further comprises a third section, wherein said second section and said third section are joined together by a hinge assembly such that the second and third sections are configurable between a first position and a second position;

wherein the second section comprises a tooth member and the third section comprises a recess, wherein said tooth member of the second section is received into said recess of the third section when said second section and the third section are configured to the first position.

* * * * *